US011732944B2

(12) United States Patent
Stewart et al.

(10) Patent No.: US 11,732,944 B2
(45) Date of Patent: Aug. 22, 2023

(54) APPARATUS AND METHOD FOR CRAFT ICE PRODUCTION

(71) Applicant: Singular Ice LLC, Brookfield, WI (US)

(72) Inventors: Jay T. Stewart, Brookfield, WI (US); Gary Gin, Phoenix, AZ (US); Nathan D. Stewart, Brookfield, WI (US)

(73) Assignee: Singular Ice LLC, Brookfield, WI (US)

( * ) Notice: Subject to any disclaimer, the term of this patent is extended or adjusted under 35 U.S.C. 154(b) by 0 days.

(21) Appl. No.: 17/460,643

(22) Filed: Aug. 30, 2021

(65) Prior Publication Data

US 2022/0065516 A1 Mar. 3, 2022

Related U.S. Application Data

(60) Provisional application No. 63/072,612, filed on Aug. 31, 2020.

(51) Int. Cl.

| | |
|---|---|
| ***F25C 5/08*** | (2006.01) |
| ***F25C 1/12*** | (2006.01) |
| ***F25C 1/20*** | (2006.01) |

(52) U.S. Cl.

CPC ..... *F25C 5/08* (2013.01); *F25C 1/12* (2013.01); *F25C 1/20* (2013.01); *F25C 2700/02* (2013.01); *F25C 2700/12* (2013.01)

(58) Field of Classification Search

CPC .... F25C 5/185; F25C 5/14; F25C 1/02; F25C 1/12; F25C 5/182; F25C 5/08; F25C 2700/12; F25C 1/20; F25C 2700/02

See application file for complete search history.

(56) References Cited

U.S. PATENT DOCUMENTS

| | | | | |
|---|---|---|---|---|
| 2,995,905 A * | 8/1961 | Ayres | F25C 1/12 | 62/460 |
| 4,432,529 A * | 2/1984 | McMillan | F25C 1/243 | 249/129 |
| 2014/0137576 A1* | 5/2014 | Culley | F25C 5/18 | 62/71 |
| 2014/0165624 A1* | 6/2014 | Boarman | F25C 1/18 | 62/340 |

FOREIGN PATENT DOCUMENTS

| | | | | |
|---|---|---|---|---|
| CN | 108019994 | * | 5/2018 | F25C 1/20 |
| KR | 960012324 | * | 9/1996 | H02H 9/04 |

OTHER PUBLICATIONS

GE Appliances & Lighting, "Monogram Under-the-Counter Icemaker", Technical Service Guide, Mar. 2010, 7 pages.

GE Appliances and Lighting, "Monogram Under-the-Counter Ice Maker", Technical Service Guide, Mar. 2010, 44 pages.

* cited by examiner

*Primary Examiner* — Cassey D Bauer

(74) *Attorney, Agent, or Firm* — Michael Best & Friedrich LLP

(57) ABSTRACT

A freezing and cutting assembly and method for producing ice cubes. The freezing and cutting assembly includes a freezing unit configured to freeze a slab of ice. The freezing unit includes a cold plate and a frame removably coupleable to the cold plate. The cutting unit includes at least one heated electrical wire tensioned on a cutting unit frame and configured to divide the slab of ice into ice cubes.

18 Claims, 10 Drawing Sheets

APPARATUS AND METHOD FOR CRAFT ICE PRODUCTION

CROSS-REFERENCE TO RELATED APPLICATION

This application claims priority to U.S. Provisional Patent Application No. 63/072,612, filed on Aug. 31, 2020, the entire contents of which are incorporated herein by reference.

BACKGROUND

The present disclosure relates to ice making, and more particularly to an apparatus and method for making clear craft ice. Clear craft ice may have many different uses, such as but not limited to consumption in craft beverages.

The present disclosure also relates to an apparatus and method for producing and dividing a relatively thick ice slab into ice cubes. Known methods for dividing a relatively thick ice slab into ice cubes include using a saw blade (e.g., a blade such as metal having a serrated cutting edge or other tooth form, or other type of abrasive cutting edge, for mechanical material removal) to cut through the thick slab. For producing smaller ice cubes from a smaller slab having a relatively small thickness, the Monogram™ Under-the Counter Icemaker by GE divides a small slab of ice having a thickness of about 0.5 inches into ice cubes using a cutter grid. The Monogram™ Under-the Counter Icemaker Service Guide identifies that a problem is present if the ice slab has a thickness of ¾ inches or larger (p. 38, Table, Col. 1) with probable causes including scale buildup, defective or disconnected hot gas valve, and room temperature over 100 degrees Fahrenheit (id, Col. 2).

SUMMARY

Using heat from an electric wire to divide an ice slab causes melting of frozen ice into meltwater. Known usage of electric wires to divide ice is limited to small, shallow ice slabs having a thickness of less than ¾ inches, thereby minimizing meltwater volume. Thicker ice slabs, such as those having a thickness of at least 1 inch, present challenges to the heated cutting method because of increased volume of meltwater as a result of a longer dividing process. Meltwater can refreeze and cause divided ice cubes to clump together.

In one aspect, the disclosure provides a freezing and cutting assembly for producing ice cubes. The freezing and cutting assembly includes a freezing unit configured to freeze a slab of ice. The freezing unit includes a cold plate and a frame removably coupleable to the cold plate. The cutting unit includes at least one heated electrical wire tensioned on a cutting unit frame and configured to divide the slab of ice into ice cubes.

In another aspect, the disclosure provides a freezing and cutting assembly for producing ice cubes. The freezing and cutting assembly includes a freezing unit configured to freeze a slab of ice, and a cutting unit configured to receive the slab of ice from the freezing unit. The cutting unit includes at least one heated electrical wire tensioned on a cutting unit frame and configured to divide the slab of ice into ice cubes. The freezing and cutting assembly also includes a tray configured to receive the ice cubes from the cutting unit. The tray includes dividers configured to separate the ice cubes from each other.

In yet another aspect, the disclosure provides a freezing and cutting assembly for producing ice cubes. The freezing and cutting assembly includes a first freezing unit configured to form primary slabs of ice, a second freezing unit configured to form secondary slabs of ice, and a cutting unit configured to alternatingly receive the primary and secondary slabs of ice from the first and second freezing units. The cutting unit is configured to divide each of the primary and secondary slabs of ice into ice cubes.

In yet another aspect, the disclosure provides a method for producing ice cubes. The method includes coupling a removably coupleable frame to a refrigerated cold plate to define an enclosure for receiving a fluid, freezing the fluid in the enclosure into a slab of ice, transferring the slab of ice to a cutting unit having heated electrical wires, and dividing the slab of ice into ice cubes using the heated electrical wires.

In yet another aspect, the disclosure provides a method for producing craft ice including forming an enclosure around a refrigerated cold plate, filling the enclosure with water, stirring the water while the refrigerated cold plate freezes the water into an ice block, transferring the ice block to a cutting unit, cutting the ice block into ice cubes with heated wires, providing a tray with shallow dividers below the heated wires to receive ice cubes, and refreezing the ice cubes on the tray.

In yet another aspect, the disclosure provides a method for producing craft ice including providing a temperature-controlled enclosure around a freezing unit for producing an ice block and a cutting unit for cutting the ice block into ice cubes, producing the ice block using the freezing unit in the temperature-controlled enclosure, and cutting the ice block using the cutting unit in the temperature-controlled enclosure.

In yet another aspect, the disclosure provides an apparatus for producing craft ice including a production assembly having one or more freezing units and one or more cutting units. The production assembly includes a temperature-controlled enclosure for controlling the ambient environment around the one or more freezing units and the one or more cutting units.

In some implementations, the production assembly includes a refrigerated storage space for storing ice cubes.

Other aspects of the disclosure will become apparent by consideration of the detailed description and accompanying drawings.

Before any implementations of the disclosure are explained in detail, it is to be understood that the disclosure is not limited in its application to the details of construction and the arrangement of components set forth in the following description or illustrated in the following drawings. The disclosure is capable of other implementations and of being practiced or of being carried out in various ways. The terms "substantially", "generally", and "about" may be used herein to encompass both "exactly" and "approximately."

DETAILED DESCRIPTION

Figure 1:
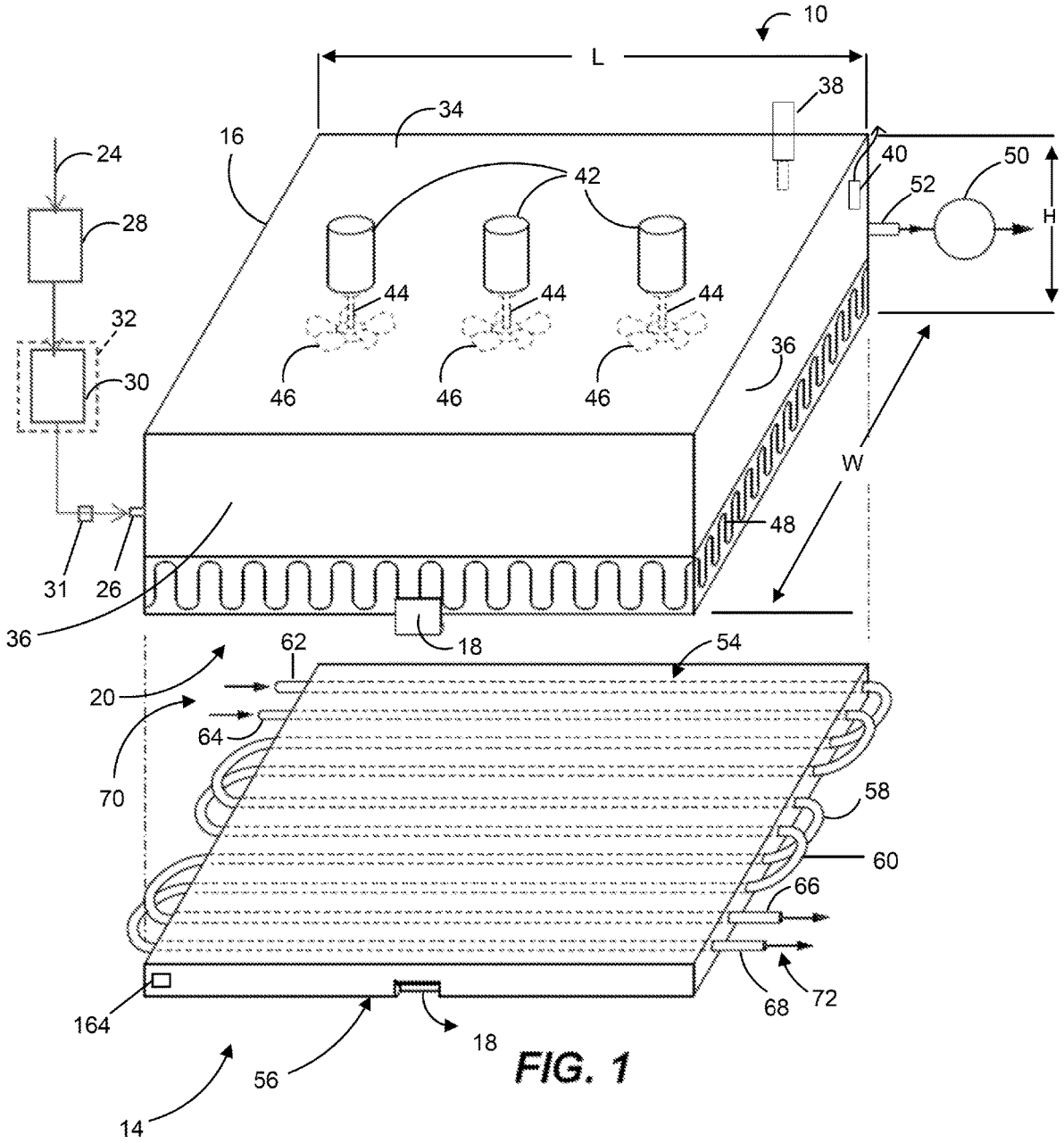
FIG. 1 is a schematic perspective view of a freezing unit including a cold plate and a frame for producing an ice block.
Figure 5:
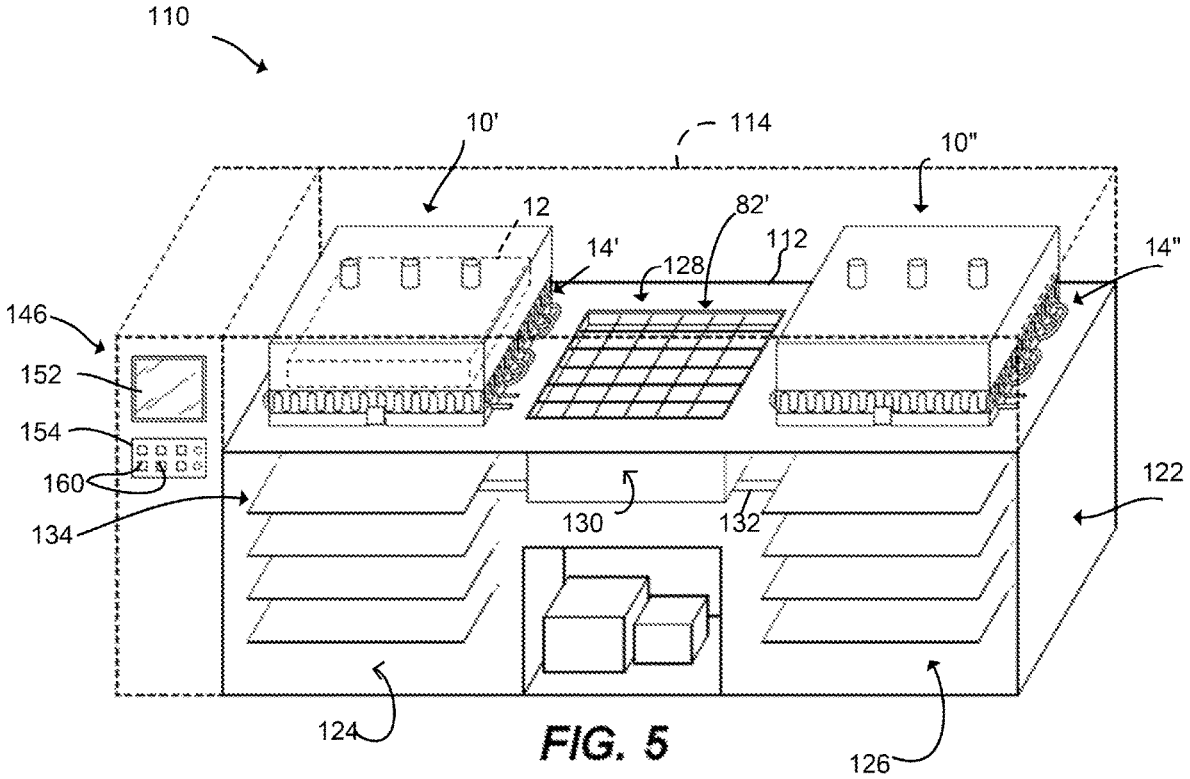
FIG. 5 is a schematic perspective view of a temperature-controlled production assembly including two of the freezing units of FIG. 1 and one of the cutting units of FIGS. 4A-4B according to one implementation of the disclosure.
Figure 6:
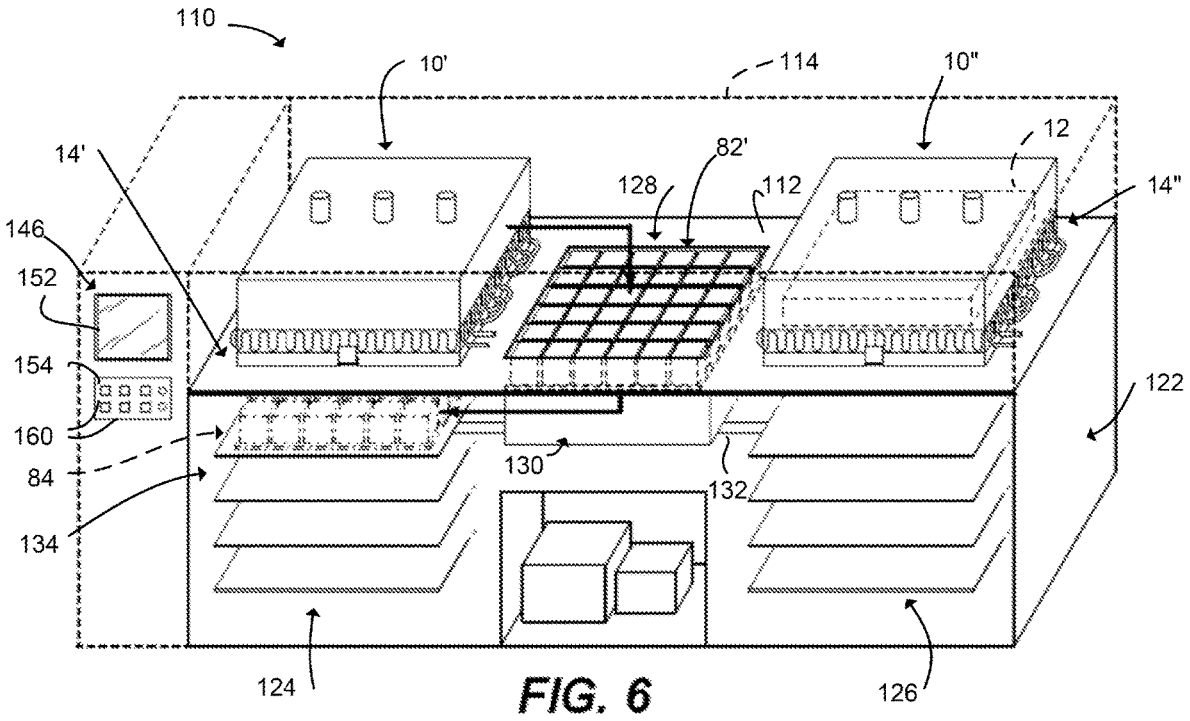
FIG. 6 is the schematic perspective view of FIG. 5 showing the ice block being cut into ice cubes by the cutting unit and being received by a tray.
Figure 7:
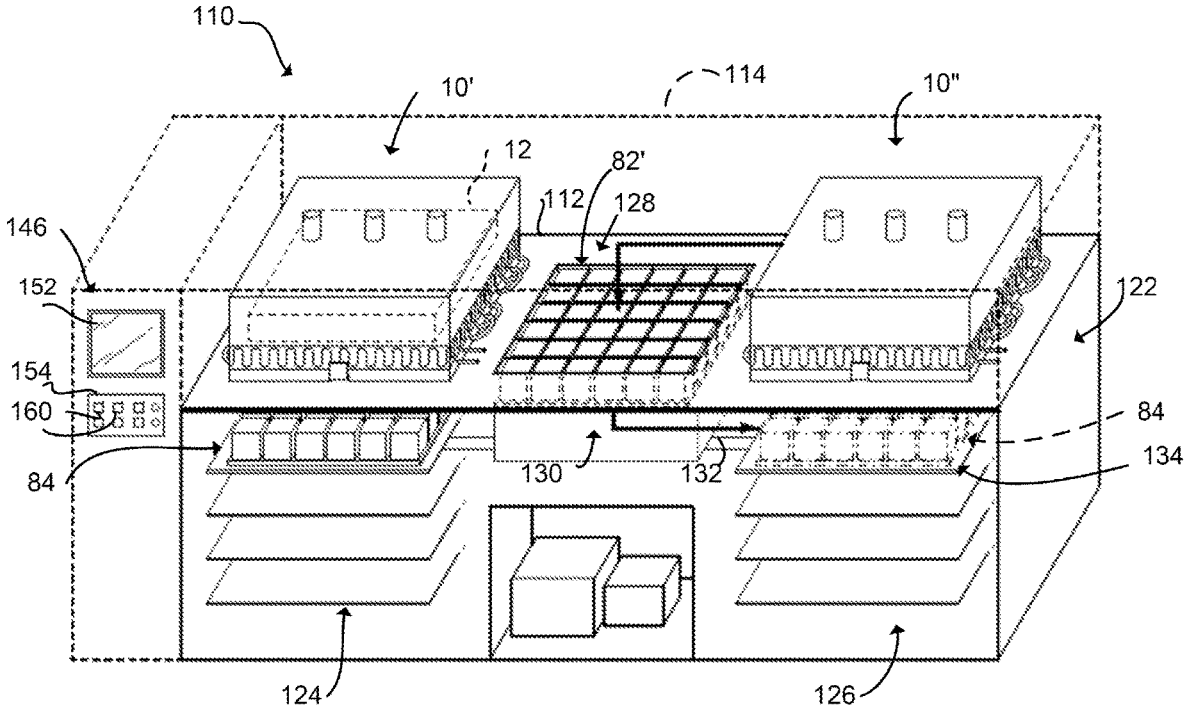
FIG. 7 is the schematic perspective view of FIG. 5 showing the tray of ice cubes being moved alternatingly into a temperature-controlled storage unit.

FIG. 1 illustrates a freezing unit 10 for freezing a block of ice 12 (which may be referred to herein as an ice block 12 and/or a slab of ice 12 and is illustrated in FIGS. 5-7). The freezing unit 10 includes a cold plate 14 and a frame 16 removably coupleable to the cold plate 14. In the illustrated implementation, the cold plate 14 and the frame 16 are coupleable selectively between a coupled state and an uncoupled state by way of a latch 18, which may include any suitable fastener for selectively coupling and uncoupling the cold plate 14 and the frame 16. In the coupled state, the cold plate 14 and the frame 16 are coupled and form an enclosure 20, which is a hollow enclosed space capable of being filled with water. The cold plate 14 and the frame 16 may form a water-tight seal therebetween in the coupled state, e.g., by way of the frame 16 being mounted in compression against the cold plate 14 and/or having an elastomeric seal (not shown), or in any other suitable manner. In some implementations, the freezing unit 10 includes a frame lift 22 (illustrated schematically in FIG. 9), such as a hydraulic lift, for automatically moving the frame 16 and/or the cold plate 14 between the coupled and uncoupled states.

A fluid source 24, such as water or another fluid from a utility, a well, a holding tank, etc., is in fluid communication with the enclosure 20 by way of an inlet port 26. For example, in the illustrated implementation, pressurized utility or well water passes through a filter 28, such as a reverse osmosis filter, and is subsequently held in a storage tank 30. The storage tank 30 provides filtered water to the enclosure 20. The storage tank 30 may include a pressurized air bladder (not shown) for creating and/or maintaining a water supply pressure. The storage tank 30 may be disposed in a refrigerated space 32, which may be incorporated into temperature-controlled enclosure 114 (as illustrated in FIGS. 5-7 and discussed in greater detail below), to pre-chill the filtered water and reduce freeze time of the freezing unit 10. A fill valve 31 may be disposed in the line to the enclosure 20 to allow manual or electronic control of filling the enclosure 20. In other implementations, the fluid source 24 may provide water directly to the enclosure 20 without a filtration system. In yet other implementations, the fluid source 24 may supply other fluids, such as juice, soda, infused water, flavored water, etc., and the fluid source 24 need not be pressurized.

The frame 16 includes a top 34 and a plurality of sidewalls 36 and is insulated to increase efficiency of freezing and inhibit cracking of ice. In the illustrated implementation, the top 34 and sidewalls 36 are generally orthogonal to each other. For example, in the illustrated implementation, the frame 16 includes four sidewalls 36 forming a generally rectangular shape that define sides of the slab of ice 12 formed on the cold plate 14. However, in other implementations, the frame 16 may have other shapes and/or a different number of sidewalls 36. The top 34 of the frame 16 may be formed as one piece with the sidewalls 36 or may be a separate piece, removably attachable to the sidewalls 36. In some implementations, the top 34 may rest on top of the sidewalls 36 during operation. Each of the sidewalls 36 and the top 34 may include insulation, such as polystyrene foam, or another suitable insulating material. In some implementations, some of the sidewalls 36 and/or the top 34 may be uninsulated, in any combination.

An ice thickness sensor 38, such as a linear actuator with a limit switch, may be coupled to the frame 16, e.g., to the top 34 of the frame 16. In the implementation in which the ice thickness sensor 38 includes a linear actuator, the linear actuator may be configured to extend downwards towards the cold plate 14 to measure a height (which may also be referred to herein as a thickness or an ice thickness) of the forming ice, as will be described in greater detail below. In other implementations, other types of ice thickness sensors may be employed. A temperature sensor 40 may be coupled to the frame 16 to measure a temperature of the water in the enclosure 20, and a cold plate temperature sensor 164 may measure a temperature of the cold plate 14.

Figure 2:
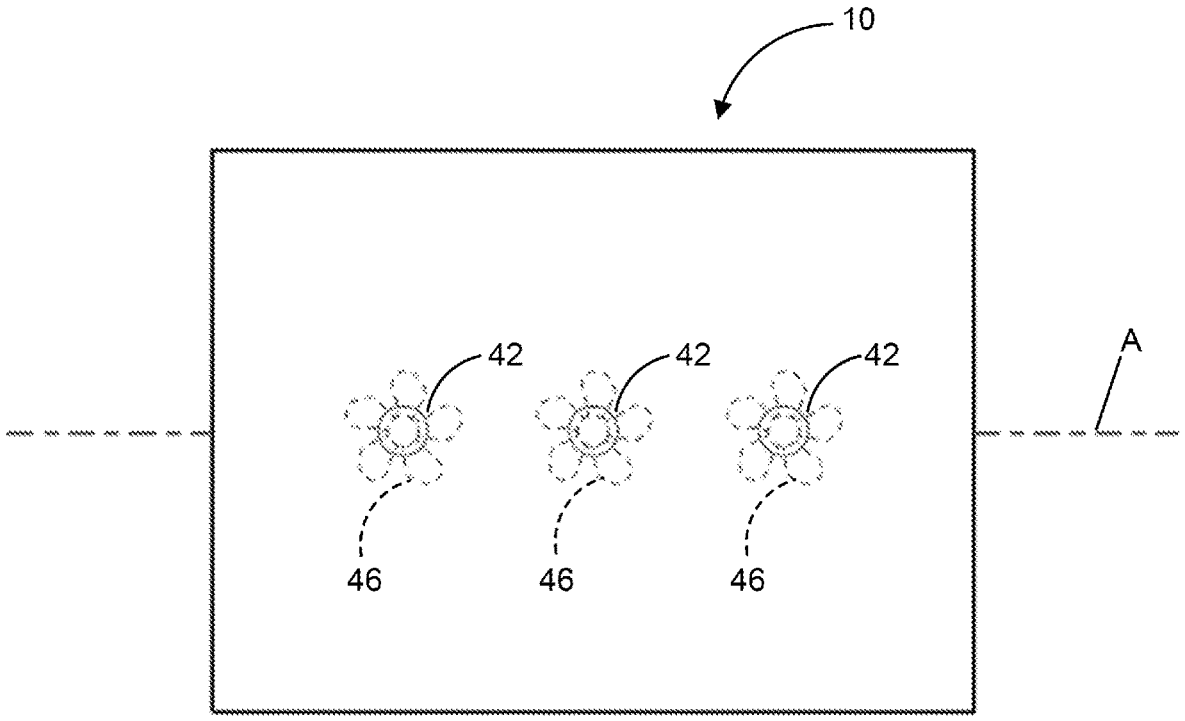
FIG. 2 is a schematic top view of the freezing unit of FIG. 1.

A plurality of motors 42 are mounted to the top 34 of the frame 16, each having a motor shaft 44, each passing through the top 34 and into the enclosure 20, and an impeller 46 mounted on each motor shaft 44. Each impeller 46 is disposed within the enclosure 20 for stirring the fluid in the enclosure 20, as will be described in greater detail below. As illustrated in FIG. 2, the plurality of motors 42 includes three motors 42 mounted centrally and arranged in a generally linear fashion along a central longitudinal axis A of the top 34, evenly spaced across the top 34 of the frame 16, and mounted at uniform height (H) above the cold plate 14. In other implementations, the plurality of motors 42 may be mounted to any side of the freezing unit 10, the number of motors 42 may be two, four, or more in other implementations, and the arrangement of motors 42 may be linear, non-linear, staggered, grid-like, etc., mounted at the same height or different heights above the cold plate 14. In yet other implementations, a single motor 42 may be employed.

The overall dimensions of the enclosure 20 are about 24 inches in length L, about 16 inches in width W, and about 8 inches in height H (+/−1 inch). The enclosure 20 dimensions are described herein as an inner dimension between inner surfaces of the freezing unit top 34, sidewalls 36, and cold plate 14 that define the enclosure 20. In other implementations, any desired dimensions may be employed in order to produce ice of any desired size. For example, the dimensions of the enclosure 20 in other implementations may generally be about 8 to about 72 inches in length L, about 8 to about 60 inches in width W, and about 3 to about 12 inches in height H (+/−1 inch). In yet other implementations, the dimensions of the enclosure 20 may be about 12 to about 48 inches in length L, about 8 to about 32 inches in width W, and about 4 to about 8 inches in height H (+/−1 inch). More specifically, the dimensions of the enclosure 20 in other implementations may be about 26 inches in length L, about 18 inches in width W, and about 6 inches in height H (+/−1 inch). In other implementations, the dimensions of the enclosure 20 may be about 32 inches in length L, about 24 inches in width W, and about 6 inches in height H (+/−1 inch). In other implementations, the dimensions of the enclosure 20 may be about 48 inches in length L, about 32 inches in width W, and about 6 inches in height H (+/−1 inch). Generally, the enclosure 20 dimensions may be increased slightly above the desired dimensions of the cut ice cubes 84 to compensate for dimensional losses due to melting, e.g., during the cutting process. The number of motors 42 and/or size of the impellers 46 may be scaled up or down depending on the size of the enclosure 20.

Each of the plurality of sidewalls 36 includes a heater 48, such as a heated electrical wire, preferably disposed against the outer surface of the sidewalls 36 in direct communication with the enclosure 20. The heater 48 is disposed at a bottom of the sidewalls 36, directly adjacent the cold plate 14, and is coiled in a serpentine fashion to a height of about 2 inches (+/−0.5 inches) in the illustrated implementation. In other implementations, the heater 48 may be disposed to any desired height. Generally, the heater 48 is configured to heat at least about one fourth of the height of the enclosure 20, directly adjacent the cold plate 14.

A pump 50 for pumping fluid out of the enclosure 20 is disposed in fluid communication with the enclosure 20 by way of an outlet port 52. The outlet port 52 is in fluid communication with the fluid that remains above any ice formed in enclosure 20. The pump 50 may be configured to direct the pumped fluid to a drain, a reservoir, or the like, and in other implementations the pump 50 may be configured to recycle the pumped fluid back to storage tank 30 or inlet port 26. The operation of pump 50 and outlet port 52 may be combined with fill valve 31 and inlet port 26 such that filling and draining of enclosure 20 is performed with one port.

The cold plate 14 includes a generally planar heat exchange surface 54 disposed at a top of the cold plate 14 in direct communication with the enclosure 20. The cold plate 14 may also include a generally planar bottom surface 56 generally parallel to the heat exchange surface 54. One or both of the heat exchange surface 54 and the bottom surface 56 may be formed from a heat conductive material, such as metal—for example, aluminum, or any other suitable material. The aluminum may be anodized to inhibit formation of aluminum oxide. The cold plate 14 may also include a polycarbonate layer (not shown) disposed on the heat exchange surface 54 in direct communication with the enclosure 20 to better match an ice expansion coefficient and reduce ice adhesion to the heat exchange surface 54. First and second heat exchanger coils 58, 60 carrying a refrigerant run through the cold plate 14 in a serpentine fashion. The first and second heat exchanger coils 58, 60 are interleaved and are disposed between the heat exchange surface 54 and the bottom surface 56, e.g., sandwiched therebetween. The cold plate 14 may be insulated (e.g., below the bottom surface 56 of the cold plate 14) with any suitable insulating material, such as polystyrene foam.

In the illustrated implementation, first and second heat exchanger coils 58, 60 are disposed in the cold plate 14. The cold plate 14 includes first and second inlets 62, 64 in a first end 70 of the cold plate 14 and first and second outlets 66, 68 in a second end 72 generally opposite the first end 70. The first and second heat exchanger coils 58, 60 are formed from tubes, such as copper tubes, and are configured in parallel to receive a flow of refrigerant flowing in the same direction. However, in other implementations, the first and second heat exchanger coils 58, 60 may be configured to receive the flow of refrigerant in opposite directions such that the first inlet 62 and the second outlet 68 are disposed at the first end 70, and the first outlet 66 and the second inlet 64 are disposed at the second end 72. In other implementations, three, four, or more heat exchanger coils may be employed and may be arranged in any suitable configuration, e.g., for smaller spacing between coil runs and increased capacity. In yet other implementations, only a single heat exchanger coil need be employed.

Figure 3:
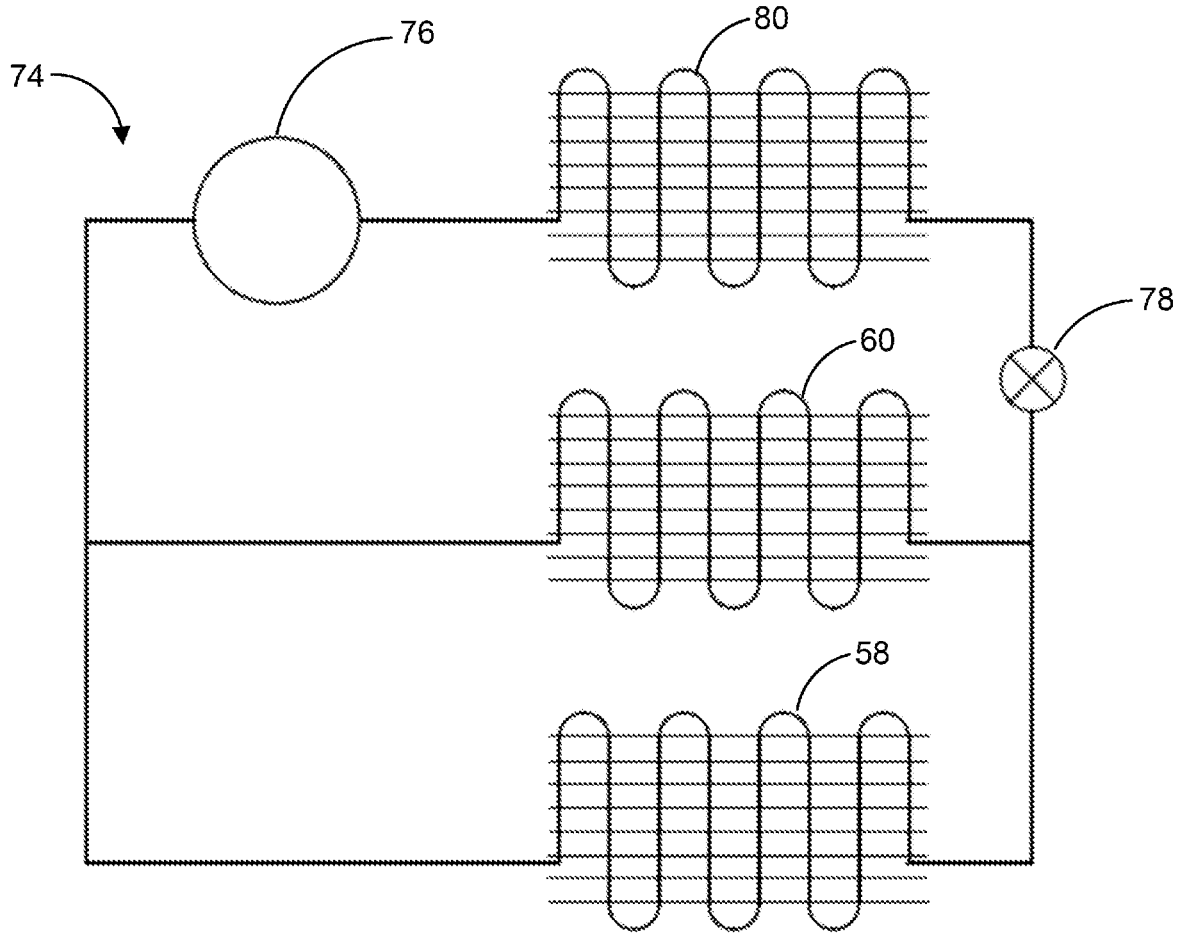
FIG. 3 is a schematic diagram of a refrigeration system for the cold plate of FIG. 1.

The first and second heat exchanger coils 58, 60 form part of a refrigeration system 74, illustrated in FIG. 3. The refrigeration system 74 generally includes a compressor 76, the first and second heat exchanger coils 58, 60 in parallel with each other, an expansion valve 78, and a third heat exchanger coil 80. The refrigeration system 74 may have a fixed capacity or a variable capacity. The refrigeration system 74 is reversible and may operate in a cooling mode and a heating mode, selectively. In the cooling mode, the first and second heat exchanger coils 58, 60 serve as evaporator coils to cool the cold plate 14 and the third heat exchanger coil 80 serves as a condenser to reject heat from the system. In the heating mode, the first and second heat exchanger coils 58, 60 serve as the condenser to heat the cold plate 14 and the third heat exchanger coil 80 serves as the evaporator to absorb heat from the environment. The reversibility may be achieved by reversing the compressor 76 to change the direction of fluid flow in the circuit or by including a switching valve 166 (illustrated schematically in FIG. 9) and piping arrangement (not shown) to selectively direct compressed refrigerant from the compressor 76 to the third heat exchanger coil 80 when the switching valve 166 is in a first position (corresponding with the cooling mode) and to the first and second heat exchanger coils 58, 60 when the switching valve 166 is in a second position (corresponding to the heating mode). Any other suitable arrangement for reversing the refrigeration system 74 may also be employed.

Figure 4A:
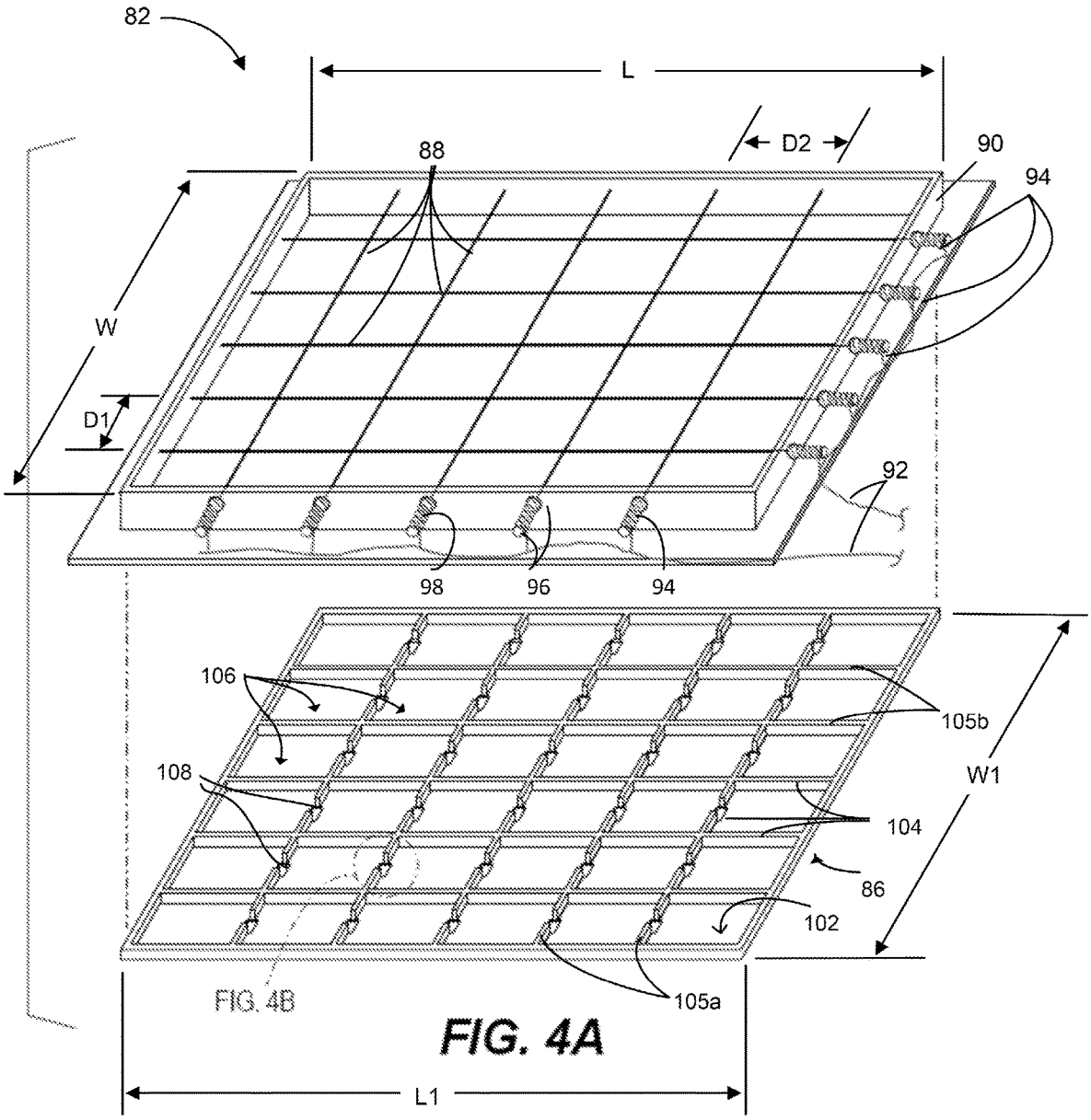
FIG. 4A is a schematic perspective view of a cutting unit for receiving and cutting the ice block produced by the freezing unit of FIG. 1 and a tray for receiving ice cubes cut by the cutting unit.
Figure 4B:
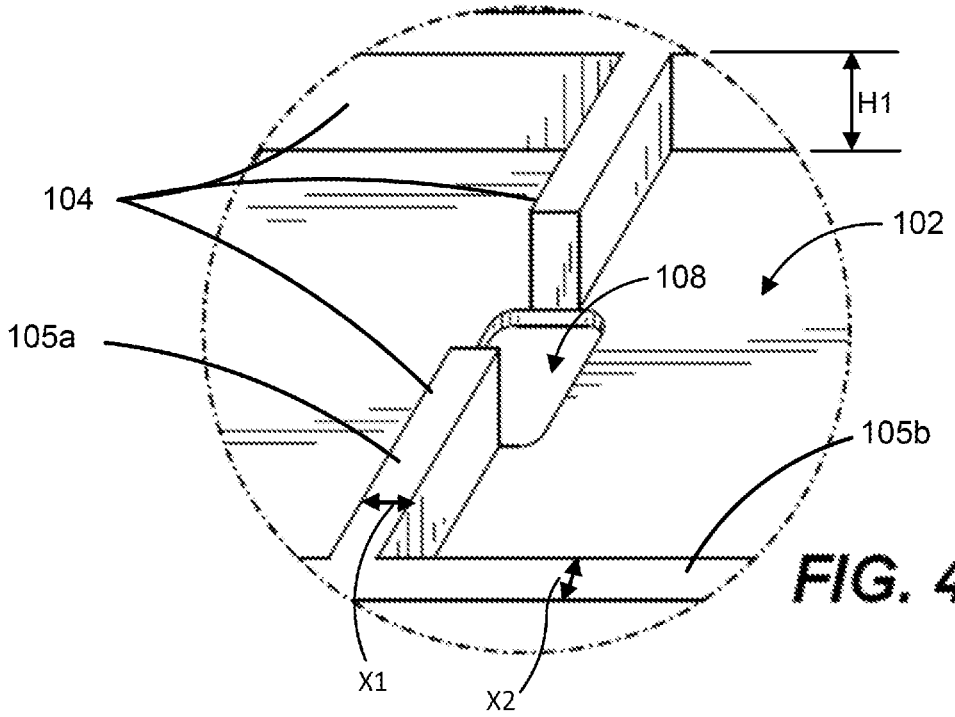
FIG. 4B is an enlarged view of a portion of the tray of FIG. 4A.

FIGS. 4A-4B illustrate a cutting unit 82 for cutting the ice block 12 into ice cubes 84 and a tray 86 for separating the ice cubes 84 for storage. The term "ice cube" is used herein to refer to any shape of ice cut by the cutting unit 82, including but not limited to a square cube, a rectangular cuboid, a parallelepiped, a stick or spear, a cylinder, or any other extruded shape with any combination of straight and/or curved edges, such as an extruded polygon, star, semi-circle, etc. The cutting unit 82 includes a plurality of heated wires 88, such as heated electrical wires, tensioned on a cutting unit frame 90 and electrically coupled to a non-heated electrical wire 92 providing power to the plurality of heated wires 88. In the illustrated implementation, the heated wires 88 are formed from stainless steel or another suitable metal or other material. The plurality of heated wires 88 may each be tensioned by way of a biasing member 94, such as coil spring, such that the tension is adjustable individually, as illustrated. Each heated wire 88 includes spacers 96 and a sleeve 98 for insulating the heated wire 88 from the cutting unit frame 90, which may be formed from acrylic or another suitable polymeric or plastic material. The spacers 96 and sleeve 98 may be formed from a high temperature insulating material. In other implementations, one or more of the heated wires 88 may be grouped together with one or more biasing members 94 to be tensioned and adjustable as a group, and the biasing member 94 may include other types of springs and tensioning elements, such as leaf springs and the like.

The cutting unit 82, and more specifically the inner dimensions of the cutting unit frame 90, generally has the same length L and width W as the enclosure 20 (+/−1 inch), or may be larger in one or both dimensions in other implementations. This allows the ice block 12 to fit in the cutting unit 82, within the cutting unit frame 90, and may provide some extra space to account for the ice block 12 melting during the cutting process, which will be described in greater detail below. The freezing unit 10 may also include an ice block ram 100 (illustrated schematically in FIG. 9) for pushing the ice block 12 horizontally (e.g., in the lengthwise direction L) to move the ice block 12 from the freezing unit 10 to the cutting unit 82. For example, the ice block ram 100 may include a hydraulic ram, an electrical linear actuator, or other suitable ram or sliding/pushing mechanism.

The plurality of heated wires 88 may be arranged in parallel in the lengthwise and widthwise dimensions L, W to form a grid, each of the heated wires 88 spaced from a directly adjacent one of the heated wires 88 by wire spacings D1 and D2 in each dimension, respectively, according to any desired size of ice cubes 84, as illustrated. The heated wires 88 may also be spaced from each other in the height direction by a small gap, enough so that overlapping heated wires 88 in the grid do not touch each other. Furthermore, the cutting unit frame 90 may be formed from two separate pieces (not shown)—e.g., a first frame part for tensioning the lengthwise heated wires 88 and a second frame part for tensioning the widthwise heated wires 88, with the first and second frame parts being stacked one on top of the other for operation, which also provides the small gap between the heated wires 88 in the height direction.

The cutting unit 82 may include a plurality of cutting unit frames 90. The cutting unit frame 90 may be interchangeable with other of the plurality of cutting unit frames 90 which may have different wire spacings D1, D2 to form different shapes and/or sizes of ice cubes 84, and the heated wires 88 need not be parallel. In some implementations, the heated wires 88 may be formed rigidly into any shape, including straight and/or curved shapes. For example, the heated wires 88 may be arranged in a grid of about 2 inches (D1) by about 2 inches (D2) (+/−⅛ inch), as illustrated in FIG. 4A, to form ice cubes 84 of corresponding dimension. Another (not shown) of the plurality of cutting unit frames 90 interchangeable therewith may have the heated wires 88 arranged in a grid of about 1.3 inches (D1) by about 4.8 inches (D2) (+/−⅛ inch) to form a spear-shaped ice cube of corresponding dimension. In other implementations, the heated wires 88 may be arranged to have other shapes, spacings, etc. for other desired ice cube shapes (for example, see the shapes listed above).

The tray 86 has overall dimensions W1, L1 that are at least equal to the length L and width W of the enclosure 20, and are slightly larger than the length L and the width W of the enclosure 20 in the illustrated implementation. The tray 86 includes a generally planar base surface 102 and a plurality of dividers 104 protruding from the base surface 102. Walls 105*a* of the plurality of dividers 104 extending in the direction of width W have a width X1 (see enlarged view of FIG. 4B) and walls 105*b* of the plurality of dividers 104 extending in the direction of length L have a width X2. In the illustrated implementation, the overall length L1 and width W1 of the tray 86 is increased over length L and width W of the enclosure 20 by the addition of all the widths X2 in the direction of the length L1 and all the widths X1 in the direction of the width W1. The divider width X1, X2 is sufficient to reduce the amount of melted fluid that remains between adjacent ice cube 84 surfaces without significantly increasing the dimensions of the tray 86. For example, each divider 104 may increase the overall length L1 and width W1 of the tray 86 by 0.0625 inches to 0.5 inches. In other words, each of the divider widths X1, X2 may be 0.0625 inches to 0.5 inches. For example, in the illustrated implementation the divider widths X2, X2 are 0.0625 inches to 0.125 inches.

The plurality of dividers 104 define a plurality of shallow receptacles 106, one receptacle 106 for each ice cube 84 cut by the cutting unit 82. The plurality of dividers 104 are positioned to separate each ice cube 84 from each of the adjacent ice cubes. A divider height H1 is sufficient to keep the ice cubes 84 in their corresponding receptacles 106 during the transportation of tray 86 to frozen storage (e.g., 0.0625 inches to 0.5 inches). This low profile of the dividers 104 inhibits the ice cubes 84 from sticking to the dividers 104 in frozen storage, as will be described in greater detail below. The tray 86 includes a plurality of apertures 108 (see enlarged view of FIG. 4B) through the base surface 102 for draining melted water away from the ice cubes 84 while the plurality of dividers 104 separate individual ice cubes 84, thereby inhibiting sticking and clumping of the ice cubes 84 to each other and to the tray 86. The plurality of apertures 108 may be disposed directly under the heated wires 88, thereby being formed through the dividers 104, as illustrated in FIGS. 4A-4B. In other implementations, the apertures 108 may be formed anywhere in the tray 86. There is generally at least one aperture 108 associated with each receptacle 106, though there may be one or more than one aperture 108 per receptacle 106 in other implementations. The tray 86 may be manually or automatically moved into a freezer storage compartment 122 (e.g., see the implementation of FIGS. 5-7 described below for automatic moving) without an operator having to directly handle the ice cubes 84. During refreezing in the storage compartment 122, the dividers 104 and apertures 108 help inhibit sticking and clumping of the ice cubes 84 to each other and inhibit the accumulation of fluid that would affect the shape of the ice cubes 84 when re-frozen. The dividers 104 also facilitate easy removal of the ice cubes 84 from the tray 86.

FIGS. 5-7 illustrate one implementation of a production assembly 110 for producing and storing ice cubes 84. The production assembly 110 includes two of the freezing units 10 illustrated in FIG. 1 (i.e., a first freezing unit 10' and a second freezing unit 10") and one of the cutting units 82 illustrated in FIG. 4A (i.e., a cutting unit 82'), each as described above. This arrangement may be referred to herein as a "dual freezing/cutting assembly". Components of the production assembly 110 that are described individually above that are part of the production assembly 110 described below may be referenced herein using the same reference numerals as above and may additionally include a prime ("") for each iteration of the component. Reference is made to the above description for each component, and only additions, differences, and/or alternatives need be described below.

The cutting unit 82' is disposed centrally between the first and second freezing units 10', 10" such that the cutting unit 82' is configured to receive an ice block 12 alternatingly from each freezing unit 10', 10". The cutting unit 82' and the freezing units 10', 10" are supported on a generally planar support surface 112. The cutting unit 82' may be configured as interchangeable modules with varying cutting dimensions such that the dimensions of ice cubes 84 are easily altered in the production assembly 110. The cutting unit 82' and the freezing units 10', 10" may be enclosed by a temperature-controlled enclosure 114. The temperature-controlled enclosure 114 provides a more consistent environment for the freezing units 10', 10" and the cutting unit 82' to produce and cut ice, shielded from fluctuations of the broader environment, thereby improving ice production consistency and reliability. In other implementations, the production assembly 110 may include any number of freezing units 10 and cutting units 82, such as three freezing units and one cutting unit, four freezing units and two cutting units, etc., in any number and combination. Further examples will be described in greater detail below.

The first and second freezing units 10', 10" are cooled by a single compressor 76, such as the compressor 76 shown in FIG. 3 and discussed above. Thus, the refrigeration system 74 for the production assembly 110 would include modifications relative to FIG. 3 such that the circuit includes another set of heat exchanger coils (i.e., fourth and fifth heat exchanger coils, not shown, for the second cold plate 14") in parallel with the first and second heat exchanger coils 58, 60 shown. The refrigeration system 74' for the production assembly 110 may also include a control valve 120 (shown schematically in FIG. 9) for controlling the ratio of refrigerant flowing to the first and second heat exchanger coils 58, 60 versus to the fourth and fifth heat exchanger coils so as to control the distribution of refrigeration capacity between the first and second freezing units 10', 10". The ratio may be adjustable so that as an ice thickness in the first freezing unit 10' increases, a portion of the refrigeration capacity is switched to the second freezing unit 10" to begin ramping up the ice-production process in the second freezing unit 10" as the ice-production process in the first freezing unit 10' ramps down, as will be discussed in greater detail below with respect to FIG. 8.

The production assembly 110 also includes a storage compartment 122 for storing the trays 86 of ice cubes 84 in a stacked fashion. The storage compartment 122 is configured to receive first and second stacks 124, 126 of trays 86 in the illustrated implementation—for example, one stack for each freezing unit 10, though any number of stacks may be employed in other implementations. The storage compartment 122 is disposed generally below the support surface 112. The support surface 112 includes an opening 128 from the temperature-controlled enclosure 114 to the storage compartment 122, and the cutting unit 82' is disposed generally in, on, or near the opening 128 such that the ice that is cut by the cutting unit 82' drops through the opening 128 into one of the trays 86 disposed in a receiving location 130 in the storage compartment 122 below. In other implementations, the tray 86 may be above the opening 128 and the tray 86 may be lowered into the storage compartment 122.

The temperature-controlled enclosure 114 and the storage compartment 122 may be cooled by a second refrigeration system having the components shown in FIG. 3 and described above. The second refrigeration system may drive separate temperatures in the temperature-controlled enclosure 114 and the storage compartment 122 with a single compressor, e.g., in a manner similar to a conventional combined refrigerator/freezer unit. In other implementations, the temperature-controlled enclosure 114 and the storage compartment 122 may be controlled by independent refrigeration systems. In yet other implementations, other configurations may be employed.

A conveyor system 132 may be disposed in the storage compartment 122, as illustrated schematically in FIGS. 5-7. The conveyor system 132 is configured to move an empty one of the trays 86 to the receiving location 130 for receiving ice cubes 84 from the cutting unit 82'. Then, when the ice cubes 84 are received and the tray 86 is loaded, the conveyor system 132 is configured to move the loaded tray 86 to a storage location 134 within one of the first or second stacks 124, 126 in the storage compartment 122. The conveyor system 132 may be configured to alternatingly select empty trays 86 from one of the first or second stacks 124, 126, and return each tray 86, once loaded, to its original storage location 134. In other implementations, the conveyor system 132 may be configured to select empty trays 86 from one of the first or second stacks 124, 126 until the respective stack 124, 126 is fully loaded and then switch to the other of the first or second stacks 124, 126 for loading. Each stack 124, 126 may include four or more trays 86 stacked generally vertically, as illustrated, though any number of trays 86 may be in a stack in other implementations.

Figure 8:
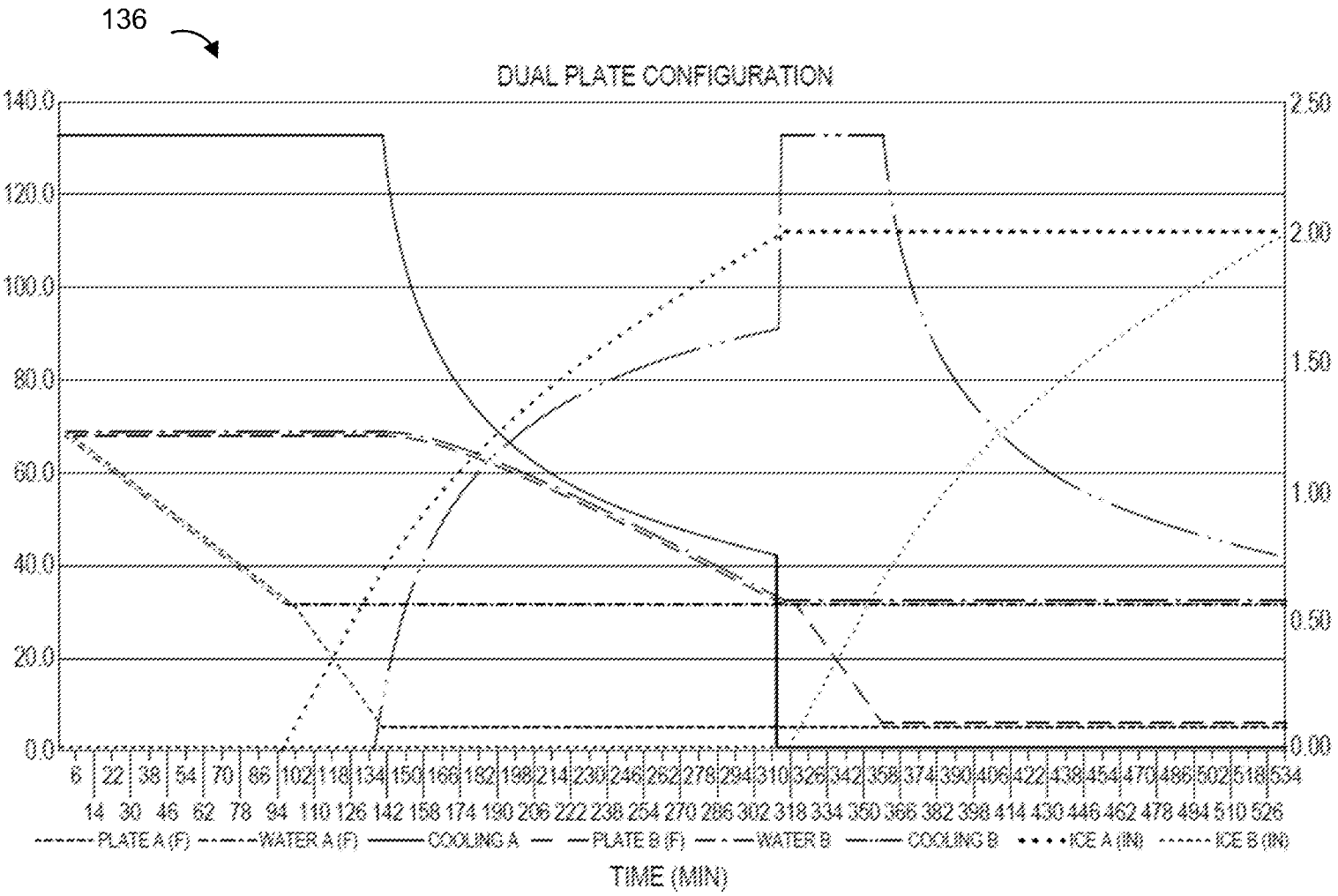
FIG. 8 is a graphical diagram of a dual freezing cycle of the temperature-controlled production assembly of FIG. 5.

FIG. 8 illustrates a dual freezing cycle 136 of the production assembly 110 having the first and second freezing units 10', 10" alternatingly supplying ice blocks 12 to a single cutting unit 82' (i.e., the dual freezing/cutting assembly). In this arrangement, a controller 140 is configured to control the refrigeration system 74' (e.g., by way of the control valve 120) to allocate varying ratios of the refrigerant to the first freezing unit 10' (and more specifically to the first cold plate 14' which may also be referred to herein as "plate A" for simplicity) and the second freezing unit 10" (and more specifically to the second cold plate 14" which may also be referred to herein as "plate B" for simplicity). FIG. 8 illustrates, over time, the temperature of plate A in degrees Fahrenheit ("PLATE A (F)"), the temperature of water above plate A in degrees Fahrenheit ("WATER A (F)"), the cooling power allocated to plate A in calories/second ("COOLING A"), the temperature of plate B in degrees Fahrenheit ("PLATE B (F)"), the temperature of water above plate B in degrees Fahrenheit ("WATER B (F)"), the cooling power allocated to plate B in calories/second ("COOLING B"), the thickness of ice over plate A in inches on the right vertical axis ("ICE A (IN)"), and the thickness of ice over plate B in inches on the right vertical axis ("ICE B (IN)").

As illustrated in FIG. 8, the dual freezing cycle 136 begins with 100% of the cooling capacity allocated to plate A, which begins to pull down the temperature of the water on plate A. After a period of pulldown time (e.g., about 94 minutes in this example), the water on plate A reaches a freezing point (32 degrees Fahrenheit) and a layer of ice begins to form on plate A. A thickness of the ice increases over a time period (e.g., about 40 minutes in this example) during which the cooling capacity remains at 100% with plate A. The time period may be preset as a time (e.g., based on a timer) or a preset ice thickness (programmed to a first thickness threshold based on a measurement from the thickness sensor 38) that triggers switching to a capacity-sharing mode. In response to the trigger, the controller 140 is in the capacity-sharing mode and begins to allocate a portion of the cooling capacity to plate B and gradually increases cooling capacity to plate B while decreasing cooling capacity to plate A. After a set period of ramping down cooling capacity to plate A and ramping up cooling capacity to plate B (e.g., about 100 minutes in this example, which may be determined by presetting the timer to a desired duration or by the thickness sensor 38 and setting a second desired thickness threshold) the cooling capacity is 50% to plate A and 50% to plate B, and the cooling capacity thereafter continues to increase to plate B and decrease to plate A. Even during the period of time that the cooling capacity to plate B is higher than the cooling capacity to plate A (e.g., from about 194 minutes on the x-axis of FIG. 8 to about 312 minutes on the x-axis of FIG. 8), plate A continues to generate increasing ice thickness while plate B is prepped for its freezing cycle and begins pulling down the temperature of water on plate B. Once the ice on plate A reaches a desired thickness (e.g., about 2 inches for cubes, about 4.8 inches for spears, etc., which may be determined by presetting a third desired thickness threshold), then 100% of the cooling capacity is allocated to plate B so plate A is deactivated (i.e., cooling capacity is zero to plate A such that plate A is turned off). The cycle then continues as described above but with plate B as the primary cold plate instead of plate A, and then the cycle repeats again with plate A as the primary cold plate as described above. If the timer is used to preset a time or duration for any given portion of the cycle described above, then it should be understood that "about" is used above with respect to a number of minutes with a margin of +/−10 minutes and that the preset times may be set to any desired duration in other implementations to achieve the desired results. The dual design more efficiently utilizes compressor cooling capacity and lowers on/off cycling of the compressor 76, thereby extending the life of the compressor 76.

In other implementations, the production assembly 110 may employ other arrangements of freezing units 10 and cutting units 82. For example, a single cutting unit 82 may be dedicated for every freezing unit 10 (which may be referred to herein as a "dedicated freezing/cutting assembly"). As another example, multiple freezing units 10 may supply ice blocks 12 to a single cutting unit 82 (which may be referred to herein generally as a "shared freezing/cutting assembly" or an "assembly line"). The multiple freezing units 10 may be synchronized such that the timing of each ice block release is spaced and driven by the cutting unit 82 capacity. Any of these arrangements may be employed individually and in other implementations may be duplicated within the production assembly 110, e.g., more than one dedicated freezing/cutting assemblies may be disposed in the temperature-controlled enclosure 114, more than one of the dual freezing/cutting assemblies may be disposed in the temperature-controlled enclosure 114, more than one of the shared freezing/cutting assemblies may be disposed in the temperature-controlled enclosure 114, or any other combination of said freezing/cutting assemblies, etc. Also, in other implementations, any combination of one or more freezing units 10 and one or more cutting units 82 may be operated individually and manually, or in any combination of manually and automatically, with or without being configured into the production assembly 110.

Figure 9:
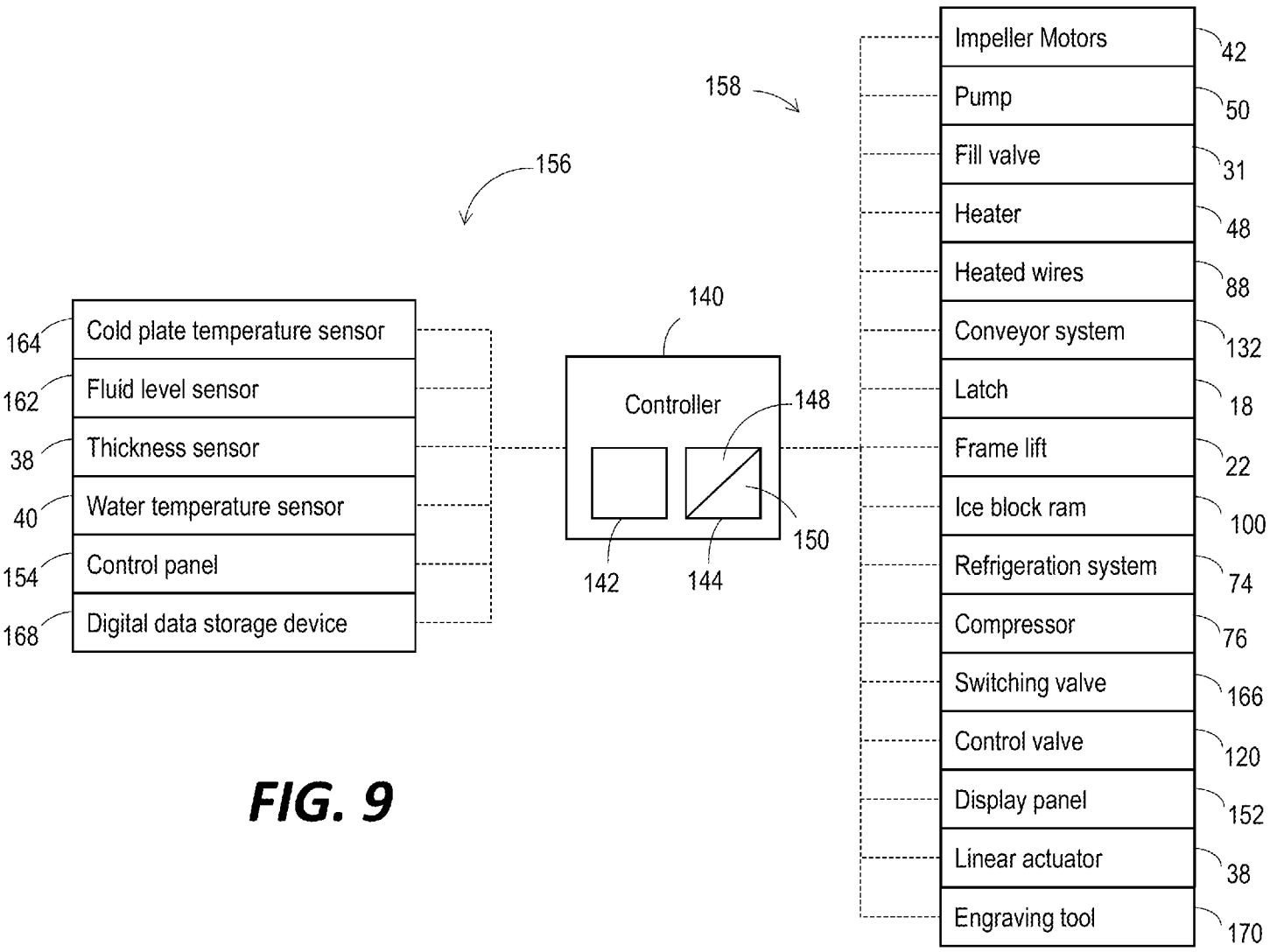
FIG. 9 is a schematic diagram of a control system for any of the implementations above.

As illustrated in FIG. 9, the controller 140 includes a programmable processor 142 (e.g., a microprocessor, a microcontroller, or another suitable programmable device), a memory 144, and a human-machine interface 146 (see FIGS. 5-7). The memory 144 may include, for example, a program storage area 148 and a data storage area 150. The program storage area 148 and the data storage area 150 can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, electronic memory devices, or other data structures. The controller 140 may also, or alternatively, include integrated circuits and/or analog devices, e.g., transistors, comparators, operational amplifiers, etc., to execute the logic and control signals described herein.

The human-machine interface 146 includes a display panel 152 and a control panel 154. The display panel 152 may display information regarding temperature and setpoint of the temperature-controlled enclosure 114, temperature and setpoint of the first and second cold plates 14', 14", an operation state (e.g., the mode) of the refrigeration system 74 and/or the capacity allocation to the first and second cold plates 14', 14", an operation state of the motors 42, an operation state of the heaters 48, water temperature, cold plate temperature, an operation state of the cutting unit 82, 82', the timer, an indicator representative of the number of loaded trays 86 or the amount of ice in the storage compartment 122, etc.

The controller 140 includes a plurality of inputs 156 and outputs 158 to and from various components, as illustrated in FIG. 9. The controller 140 is configured to provide control signals to the outputs 158 and to receive data and/or signals (e.g., sensor data, user input signals, etc.) from the inputs 156. The inputs 156 may include, but are not limited to, the control panel 154, a fluid level sensor 162, the water temperature sensor 40, the cold plate temperature sensor 164 (and other temperature sensors to any other component described herein), the thickness sensor 38, and a digital data storage device 168, and may include other components described herein. The outputs 158 may include, but are not limited to, the impeller motors 42, the pump 50, the refrigeration system 74 (e.g., the compressor 76, the control valve 120, the switching valve 166), the fill valve 31, the heater 48, the heated wires 88, the conveyor system 132, the latch 18, the frame lift 22, the ice block ram 100, the display panel 152, and the linear actuator 38, and an engraving tool 170, and may include other components described herein. Thus, the controller 140 may be programmed to automatically control any of these components, as will be described in greater detail below.

The control panel 154 may include a plurality of control actuators 160 (see FIGS. 5-7), such as buttons including mechanical, capacitive touch, resistive, etc., as well as knobs, dials, etc. in any combination, for providing an input control signal to the controller 140 to control any of the components of the production assembly 110, such as those shown in FIG. 9.

The inputs 156 and outputs 158 are in communication with the controller 140, e.g., by way of hard-wired or wireless communications such as by satellite, internet, mobile telecommunications technology, a frequency, a wavelength, Bluetooth®, or the like.

In operation, the controller 140 may be configured to automatically fill the enclosure 20 (in a fill mode) to a desired height for the desired size of ice cube, e.g., by way of the fluid level sensor 162 in communication with the controller 140 and a feedback control loop with the fill valve 31. The desired height is preferably higher than the desired ice cube height in order to allow continued stirring of the fluid during the freezing process as the fluid freezes. For example, the desired ice cube height is at least 1 inch and the desired height is at least 2 inches to allow continued stirring as the ice slab forms to the height of 1 inch. In other examples, the desired ice cube height is at least 1.5 inches and the desired height is at least 2.5 inches. In yet other examples, the desired ice cube height is at least 2 inches and the desired height is at least 3 inches. In yet other examples, the desired ice cube height is more than 2 inches (such as at least 2.5 inches, at least 3 inches, at least 3.5 inches, at least 4 inches, at least 4.5 inches, at least 5 inches, etc.). The fluid freezes starting at the cold plate 14 in thin layers extending away from the cold plate 14 as the water is stirred by the impellers 46. In other implementations, the enclosure 20 may be manually filled by an operator to the desired height.

The controller 140 may be configured to control the refrigeration system 74 to cool the cold plate 14, 14', 14" to produce ice. In other implementations, the refrigeration system 74 may be manually operated. For example, the cold plate 14 may be set to an initial setpoint for cooling and freezing water in the enclosure 20, and then the setpoint may be lowered as ice thickness increases to a desired height. The thicker the ice, the larger the temperature difference may be between the 32-degree water above the ice and the cold plate 14 below. As such, lowering of the setpoint as the ice thickens may facilitate further freezing. Then, the setpoint may be increased slowly with either the compressor 76 being off or running only occasionally to slow the rate of temperature increase to inhibit cracking of the ice. The temperature of the cold plate may be raised further by reversing the refrigeration system 74 to use the compressor's hot gas. The setpoint may be adjusted (e.g., as described above) either manually or automatically based on water temperature measured by the temperature sensor 40, based on ice thickness measured by the thickness sensor 38, and/or based on time.

For the dual first and second cold plates 14', 14", the controller 140 may be configured to control the refrigeration system 74 as described above with respect to FIG. 8.

The controller 140 may be configured to activate the impellers 46 during ice formation to continuously stir the water above the ice. Constant water movement over the forming ice facilitates the production of clear ice. The linear arrangement of impellers 46 inhibits turbulence at the top surface of the forming ice to facilitate a smoother and more planar top surface of the ice.

The controller 140 may be configured to periodically or continuously monitor ice thickness, e.g., by way of the thickness sensor 38, and adjust control of the refrigeration system 74 (e.g., to increase or decrease the setpoint temperature, the capacity allocation, to reverse the cold plate 14 to heating mode, etc.) based on the sensed ice thickness (e.g., based on the actual measured thickness or on the measured thickness as a percentage of the desired ice thickness, for example). For example, see FIG. 8 described above. The refrigeration system 74 may also be controlled manually in other implementations, e.g., by way of the control panel 154.

The controller 140 may be configured to activate the pump 50 to remove excess water from the enclosure 20 when the desired ice thickness is reached, as sensed by the thickness sensor 38. In other implementations, the pump 50 may be activated manually, e.g., by way of the control panel 154.

The controller 140 may also be configured to activate the heater 48 to facilitate removal of the ice block 12 from the enclosure 20 in conjunction with the cold plate 14 being in the heating mode using compressor hot gas. The heating mode may be timed to inhibit cracking of the ice. The insulation in the frame 16 may also inhibit cracking of the ice by slowing the rate of temperature change in the ice. In some implementations, the heater 48 may be activated manually by the operator, e.g., by way of the control panel 154. When the ice block 12 is not frozen to the frame 16 or the cold plate 14, the controller 140 may be configured to automatically unlatch the frame 16, to activate the frame lift 22 to move the frame 16 to the uncoupled state, and to move the ice block 12 to the cutting unit 82 by activating the ice block ram 100. In some implementations, the frame lift 22 and the ice block ram 100 may be integrated into a single lift/ram device. In some implementations, the frame 16 and ice block 12 may be unlatched and lifted to the uncoupled state and moved manually by the operator.

Prior to the ice block 12 being cut by the cutting unit 82, the engraving tool 170 (shown schematically in FIG. 9), such as a computer numerical control (CNC) router, may be used to engrave a surface of the ice block 12. For example, the engraving tool 170 may be mounted above the cutting unit 82 and configured to engrave the top surface of the ice block 12. In other implementations, the engraving tool 170 may be mounted above the cold plate 14, or above an intermediate location between the cold plate 14 and the cutting unit 82. In other implementations, the engraving tool 170 may be disposed in other locations with respect to the ice block 12, and other surfaces (such as a bottom surface and/or side surfaces) of the ice block 12 may be engraved.

The engraving may include indicia (e.g., graphics, logos, and/or text) repeated across the top surface of the ice block 12 and positioned such that one or more of the ice cubes 84 contain such indicia after the ice block 12 is cut. For example, the indicia may be placed approximately centrally in a location on the top surface of the ice block 12 corresponding to an ice cube 84 and repeated for every location on the top surface of the ice block 12 corresponding to an ice cube 84. The indicia need not be engraved for every ice cube 84, i.e, the indicia may be engraved on a portion of the ice block 12. The indicia may be the same or different in each location on the top surface of the ice block 12, and may be grouped into any number of different groups of repeating indicia.

The digital data storage device 168 (e.g., a computer, a personal computer, a laptop, a hard drive disk, a disc such as a compact disc (CD), a digital versatile disc (DVD), Blu-ray disc, or the like, a USB flash drive, a secure digital card (SD card), a solid state drive (SSD), cloud storage, etc.), shown schematically in FIG. 9, may include a set of engraving instructions for the entire ice block 12, or a portion thereof. The set of engraving instructions may be saved into a memory in the digital data storage device 168 (e.g., see the description of the memory 144 above). The digital data storage device 168 may be operably coupled to the controller 140 directly or through the control panel 154. The digital data storage device 168 may communicate with the controller 140 and/or the control panel 154 by wired or wireless communications as described above. The controller 140 may then control the operation of the engraving unit 170 to execute the engraving instructions, e.g., once the ice block 12 is moved to the cutting unit 82 or other desired location.

The controller 140 may be configured to activate the heated wires 88 in the cutting unit 82 to cut the ice block 12 into ice cubes 84. In some implementations, the heated wires 88 may be activated manually, e.g., by way of the control panel 154. The ice block 12 slowly melts through the heated wires 88 under the effect of gravity to form ice cubes 84 which drop through the cutting unit 82' into the tray 86 below. The dividers 104 facilitate separation of the ice cubes 84, while the apertures 108 in the tray 86 allow melted fluid to drop away from the ice cubes 84, thereby inhibiting sticking and clumping of ice cubes 84 to each other when the tray 86 of ice cubes 84 is refrozen, e.g., in the storage compartment 122.

The controller 140 may be configured to activate the conveyor system 132 to move the tray 86 loaded with ice cubes 84 to a storage position (FIG. 6) and to move an empty tray 86 to a receiving position underneath the cutting unit 82' for receiving the next batch of ice cubes 84.

In some implementations, the controller 140 may monitor ice production for auditing purposes. For example, data from the production assembly 110 regarding the number of freeze cycles of each cold plate 14, cutting cycles of the cutting unit 82, calculated quantity of ice produced, quantity of ice stored, quantity of ice removed from the storage compartment 122, etc., may be stored in the memory 144 and capable of transfer or upload by wired or wireless connection, e.g., to the digital data storage device 168 or another similar device. (Thus, the digital data storage device 168 may also be an output 158.) The data may be useful for monitoring production, auditing, process improvement, etc.

Thus, the disclosure provides, among other things, a method and apparatus for producing clear ice cubes. Although the disclosure has been described in detail with reference to certain preferred implementations, variations and modifications exist within the scope and spirit of one or more independent aspects of the disclosure as described.

Various features and advantages of the disclosure are set forth in the following claims.

What is claimed is:

1. A freezing and cutting assembly for producing ice cubes comprising:

a freezing unit configured to freeze a slab of ice, the freezing unit including a cold plate and a frame removably coupleable to the cold plate;

a cutting unit configured to receive the slab of ice from the freezing unit, the cutting unit including a plurality of heated electrical wires tensioned on a cutting unit frame and configured to divide the slab of ice into ice cubes; and a tray configured to receive the ice cubes, the tray including:

dividers configured to separate the ice cubes, and at least one aperture configured to drain water away from the ice cubes, wherein the dividers are disposed beneath and generally aligned with the heated electrical wires.

2. The freezing and cutting assembly of claim 1, wherein the frame forms a water-tight seal with the cold plate when coupled to the cold plate.

3. The freezing and cutting assembly of claim 1, wherein cooling capacity supplied to the freezing unit is reduced or turned off based on a signal from an ice thickness sensor.

4. The freezing and cutting assembly of claim 1, wherein the cold plate and the frame define an enclosure when coupled, and wherein the freezing unit includes at least one pump configured to pump fluid out of the enclosure.

5. The freezing and cutting assembly of claim 1, wherein the freezing unit includes at least one impeller configured to stir a fluid in the freezing unit.

6. The freezing and cutting assembly of claim 1, wherein the frame of the freezing unit includes a heater configured to selectively heat the frame for facilitating removal of the ice block from the frame.

7. The freezing and cutting assembly of claim 1, further comprising a temperature-controlled space and a controller configured to maintain a temperature in the temperature-controlled space at or below the freezing point of water, wherein the tray is disposed in the temperature-controlled space.

8. The freezing and cutting assembly of claim 1, wherein the at least one aperture is formed through one of the dividers.

9. The freezing and cutting assembly of claim 1, wherein the tray includes a generally planar base surface, wherein the dividers define walls orthogonal to the base surface.

10. The freezing and cutting assembly of claim 1, wherein the cutting unit frame is interchangeable with a plurality of cutting unit frames with different wire spacings.

11. The freezing and cutting assembly of claim 1, wherein the dividers have a width of 0.0625 inches to 0.125 inches.

12. The freezing and cutting assembly of claim 1, further comprising a refrigeration system configured to cool the cold plate, wherein the refrigeration system is reversible to heat the cold plate to facilitate removal of the ice block from the cold plate.

13. The freezing and cutting assembly of claim 1, wherein each of the dividers has a height of 0.0625 inches to 0.5 inches.

14. A freezing and cutting assembly for producing ice cubes comprising:

a freezing unit configured to freeze a slab of ice, the freezing unit including a cold plate and a frame removably coupleable to the cold plate;

a cutting unit configured to receive the slab of ice from the freezing unit, the cutting unit including at least one heated electrical wire tensioned on a cutting unit frame and configured to divide the slab of ice into ice cubes; and a tray configured to receive the ice cubes, the tray including:

dividers configured to separate the ice cubes, and at least one aperture configured to drain water away from the ice cubes;

wherein a controller is configured to automatically vary a temperature setpoint for the cold plate during the freezing of the slab of ice.

15. A freezing and cutting assembly for producing ice cubes comprising:

a first freezing unit configured to freeze a primary slab of ice, the first freezing unit including a cold plate and a frame removably coupleable to the cold plate;

a cutting unit configured to receive the primary slab of ice from the first freezing unit, the cutting unit including at least one heated electrical wire tensioned on a cutting unit frame and configured to divide the primary slab of ice into ice cubes;

a tray configured to receive the ice cubes, the tray including:

dividers configured to separate the ice cubes, and at least one aperture configured to drain water away from the ice cubes; and a second freezing unit configured to freeze secondary slabs of ice;

wherein the cutting unit is configured to alternatingly receive the primary and secondary slabs of ice from the first and second freezing units.

16. The freezing and cutting assembly of claim 15, further comprising a refrigeration system configured to allocate cooling capacity between the first freezing unit and the second freezing unit.

17. The freezing and cutting assembly of claim 15, further comprising a refrigeration system configured to control a ratio of cooling capacity between the first freezing unit and the second freezing unit such that a portion of the refrigeration capacity is switched from the first freezing unit to the second freezing unit in response to an increasing ice thickness in the first freezing unit.

18. A freezing and cutting assembly for producing ice cubes comprising:

a freezing unit configured to freeze a slab of ice, the freezing unit including a cold plate and a frame removably coupleable to the cold plate;

a cutting unit configured to receive the slab of ice from the freezing unit, the cutting unit including at least one heated electrical wire tensioned on a cutting unit frame and configured to divide the slab of ice into ice cubes;

a tray configured to receive the ice cubes, the tray including:

dividers configured to separate the ice cubes, and at least one aperture configured to drain water away from the ice cubes; and a controller configured to lift the frame and move the slab of ice from the freezing unit to the cutting unit.

* * * * *